US010450178B2

(12) United States Patent
Gattoni et al.

(10) Patent No.: US 10,450,178 B2
(45) Date of Patent: Oct. 22, 2019

(54) HAND PROTECTIVE DEVICE FOR OPENING GLASS AMPOULES

(71) Applicants: Giannina Gattoni, Buenos Aires (AR); Hernán Gustavo Maciá, Buenos Aires (AR)

(72) Inventors: Giannina Gattoni, Buenos Aires (AR); Hernán Gustavo Maciá, Buenos Aires (AR)

( * ) Notice: Subject to any disclaimer, the term of this patent is extended or adjusted under 35 U.S.C. 154(b) by 0 days.

(21) Appl. No.: 16/008,016

(22) Filed: Jun. 13, 2018

(65) Prior Publication Data

US 2018/0362315 A1 Dec. 20, 2018

(30) Foreign Application Priority Data

Jun. 13, 2017 (AR) ..... 20170101606

(51) Int. Cl.
*B67B 7/92* (2006.01)
*B26F 3/00* (2006.01)

(52) U.S. Cl.
CPC ..... *B67B 7/92* (2013.01); *B26F 3/002* (2013.01)

(58) Field of Classification Search
CPC ..... B67B 7/92; Y10T 225/30; Y10T 225/371; Y10T 225/373; B26F 3/00; B26F 3/002
USPC ..... 604/244; 241/99
See application file for complete search history.

(56) References Cited

U.S. PATENT DOCUMENTS

| | | | | | |
|---|---|---|---|---|---|
| 3,450,319 | A * | 6/1969 | Campbell, Jr. | B67B 7/92 | 225/104 |
| 3,749,271 | A * | 7/1973 | Ellis, Jr. | B67B 7/92 | 215/47 |
| 4,241,627 | A * | 12/1980 | Snow | B67B 7/92 | 294/99.2 |
| 4,659,024 | A * | 4/1987 | Frunzi | B26F 3/002 | 225/93 |
| 5,129,566 | A * | 7/1992 | Ogden | B67B 7/92 | 225/103 |
| 5,423,440 | A * | 6/1995 | Castaneda | A61J 1/065 | 215/226 |
| 6,832,703 | B1 * | 12/2004 | Scott | B67B 7/92 | 222/1 |
| 2003/0041569 | A1 * | 3/2003 | Starr | B67B 7/92 | 53/492 |
| 2007/0282279 | A1 * | 12/2007 | Wiley | B67B 7/92 | 604/244 |
| 2010/0301089 | A1 * | 12/2010 | Muller | B67B 7/92 | 225/103 |
| 2013/0193180 | A1 * | 8/2013 | Arrigo | B67B 7/92 | 225/1 |
| 2015/0353334 | A1 * | 12/2015 | Mitidieri | B67B 7/92 | 225/93 |

* cited by examiner

*Primary Examiner* — Phong H Nguyen
(74) *Attorney, Agent, or Firm* — Henry J. Cittone; Cittone Demers & Arneri LLP

(57) ABSTRACT

The invention provides a cover of resistant elastomeric material capable of tightly containing and conforming to an ampoule. The elastomeric cover incorporates a longitudinal opening for insertion and removal of the ampoule. Flexing of the cover induces breakage of the ampoule at the desired location. The body of the ampoule, with its contents, can be easily removed, while the broken-off upper portion is retained in the cover for subsequent disposal. The device protects the hands from the sharp, broken edges of the opened ampoule.

6 Claims, 2 Drawing Sheets

HAND PROTECTIVE DEVICE FOR OPENING GLASS AMPOULES

RELATED APPLICATIONS

This application claims the benefit of priority from Argentinean patent application serial number 20170101606, filed Jun. 13, 2017, the disclosure of which is incorporated herein in its entirety.

FIELD OF THE INVENTION

The invention relates to protective devices for the hands, for use in breaking open glass ampoules.

BACKGROUND OF THE INVENTION

As it is well known, the material usually used in the manufacture of ampoules for containing substances is glass. A typical ampoule conformation has a lower cylindrical part that defines the container, and a narrower upper part, generally sealed off by heating the glass to its melting point, that defines the ampoule closure, between which a perimeter narrowing defines a neck where breakage is intended to take place at the moment of opening the ampoule. This breakage generates irregular edges capable of causing injuries to the operator's hands, and potentially exposing the wound to the contents of the ampoule. There is a need for devices and methods for preventing such injuries and exposure.

Among current techniques for the breaking open of medicinal ampoules with reduced chances of injury, use is usually made of gauzes, syringe bodies (without plungers), part of the clothing of personnel, multiple layers of gloves, or a towel arranged as a protection between the ampoule and the hand of the user. These methods have inconveniences, such as diminished accuracy of the opening, and frequently cause the fall of the ampoule or the incorrect opening that may have as a result the breakage of the package, increasing the possibility of cutting injuries in the user and the spilling of the contents. Other known devices are for specific ampoule sizes, are formed of rigid materials, and/or have one or more pieces. There is a need for devices that are flexible, one-piece, adaptable to different sized ampoules, are portable, and allow for engraving or serigraphy.

SUMMARY OF THE INVENTION

The invention provides a protective device for the opening of ampoules, usually of glass, intended to prevent cuts on the hands of the user during the operation of breaking the necks of ampoules for the extraction of the substance contained therein. The device is a coat or cover of a resistant elastomeric material, capable of tightly hosting and conforming to an ampoule introduced through a longitudinal opening in the device's wall. The ampoule being placed in the interior of the device, the user exerts manual pressure to vertically hold the section of the ampoule corresponding to the substance container enclosure, the breakage of the ampoule through its neck takes place forcing the rebuttal of the upper sector due to the elasticity of the device material, after which it is possible withdraw the ampoule enclosure to use its contents, the neck being retained in order to be able to discard it without contact with the glass.

Preferably, the device has non-slip texture features in the areas specified for handling, and an upper eyebolt for passage of a cord to keep the device at hand and prevent its fall.

Considering all above, the main purpose of the present invention is to provide a protective coat within which the ampoule is easily placed, allowing its opening in one maneuver with no risk of injuries to the acting personnel, and allowing easy withdrawal of the ampoule enclosure to use its contents, with the ampoule neck retained in order to be able to discard it without contact with the glass.

To realize the advantages described above, and to facilitate the understanding of the constructive and functional characteristics of the device of the invention, a preferred embodiment is described below, that is illustrated in the enclosed drawings schematically and without a determined scale, with the express clarification that the drawings are illustrative and not limiting, and that the invention is not restricted to the specific embodiments described and illustrated.

DESCRIPTION OF A PREFERRED EMBODIMENT

Embodiments of the present invention are designed and created to protect a user's hands while opening any size of glass ampoules. Embodiments are made in a flexible and soft touch material, such as silicone, and serve to protect fingers from the glass and the contents of the ampoule by allowing users to correctly stress the cutting point while opening the ampoule.

Embodiments may adapt to any ampoule size (from 1 ml to 30 ml), and are easy to carry in a user's pocket or hand, or to hang onto for transport.

Preferred embodiments are a one-piece protector.

The various embodiments are easy to sterilize and wash, and also engravable/brandable, via for example via laser engraving or serigraphy. Embodiments are safer to use because they have no mechanisms or small pieces that can break or become loose.

In the various embodiments, user hands and fingers are safe, because if the ampoule breaks into pieces, the glass shards are kept inside the device. The various embodiments minimize the contact with the ampoule while opening and after it is open. The device of the invention is different from other ampoule protectors for example, because they are adaptable to all sizes, easy to carry because of their small dimensions, easy to use because they are of one-piece construction, and prevent injuries if the ampoule breaks into pieces.

Figure 1:
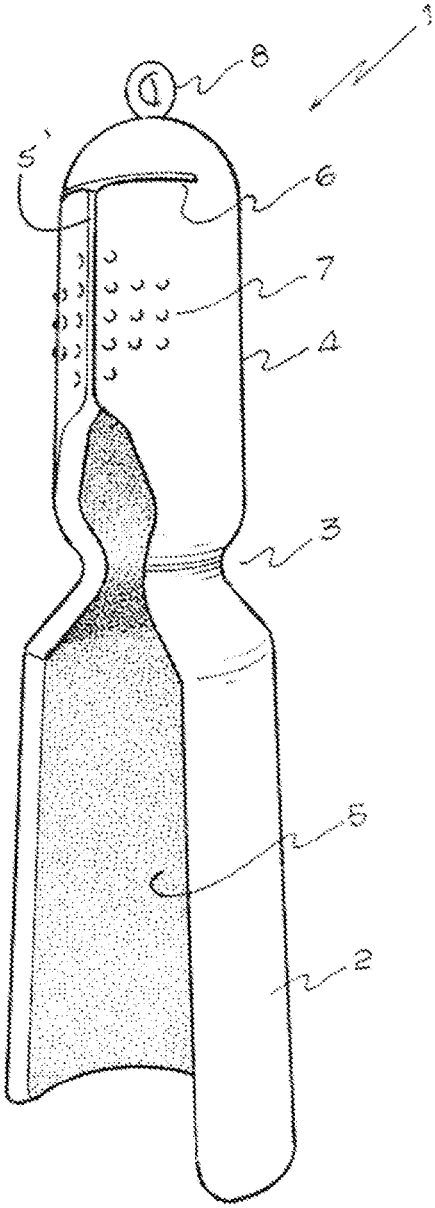
FIG. 1 is a front perspective view of the protective device.

Referring to FIG. 1, an embodiment of the invention is shown in which the device (1) is a substantially cylindrical or frustum-shaped hollow body of elastomeric material that has an internal conformation similar to the exterior conformation of an ampoule. The device comprises (a) a lower enclosure section (2) with an opening in its base consistent with the ampoule cross-section; the enclosure section and the opening having an inner diameter sufficient to accommodate the ampoule;

(b) an intermediate narrowing region (3) consistent with the cross section of the ampoule neck and having an inner diameter sufficient to accommodate the ampoule neck; and (c) an upper enclosure section (4) consistent with the cross section of the ampoule closure, and having a diameter sufficient to accommodate the closure. The device has in its wall (d) a longitudinal front opening (5).

Preferably, the front opening has a larger extent in the lower enclosure (2) than in the upper enclosure section (4), and a constriction at the intermediate narrowing region (3). Preferably, the opening narrows to a vertical slot (5') through the upper enclosure section (4), and at its upper end terminates in a transverse slot (6) below the top of the upper enclosure section. The opening may be of any size that permits easy insertion and removal of the ampoule, i.e. the ampoule may be inserted or removed via the application of a minimal, convenient, and comfortable force. In preferred embodiments, the opening will subtend between 90° and 180° of the perimeter of the lower enclosure region.

Suitable elastomeric materials include, but are not limited to, natural and synthetic rubbers, such as latex, butadiene, nitrile, urethane, or silicone rubbers, and plasticized polymers such as polyvinyl chloride.

The device can be used with smaller diameter ampoules simply by inserting them so that their necks are aligned with the narrowing region (3).

Additionally, at both sides of the vertical slot (5'), that in combination with the transverse slot (6) determine an overlapping opening for the withdrawal and the discard of the detached neck of the ampoule, the outer surface of the device preferably presents a plurality of small protuberances (7) that generate a non-slip area over which the breakage pressure is exerted.

In the embodiment illustrated in the figures, the upper end preferably has an eyebolt (8) for the passage of a hanging cord. The eyebolt is preferably integrally molded with the rest of the device.

Figure 2:
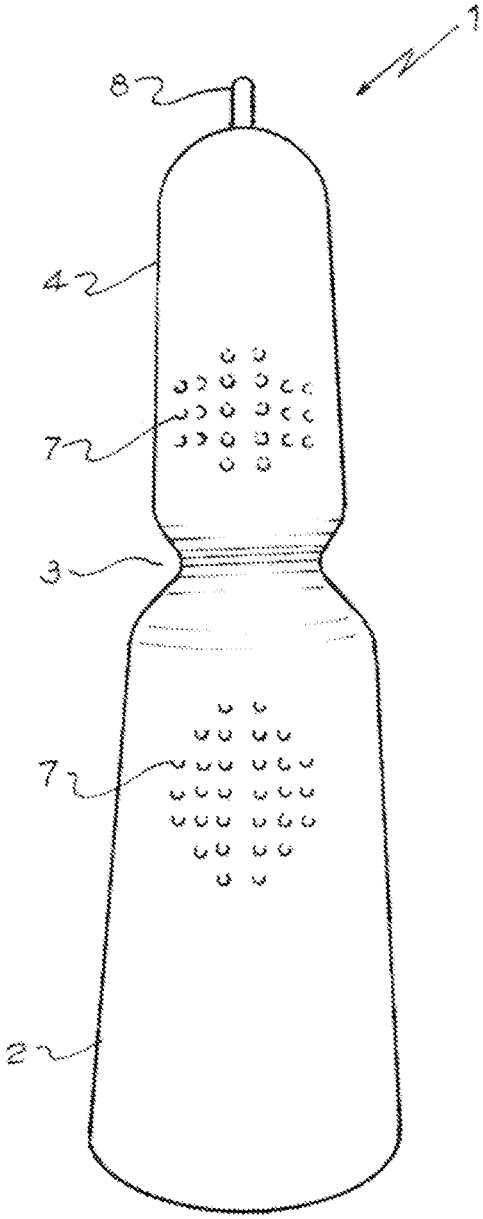
FIG. 2 is a rear perspective view of the protective device.

FIG. 2 shows the device of FIG. 1 from a rear point of view. Preferably, several non-slip areas are generated by a plurality of protuberances (7) both in the lower enclosure region (2) and in the upper enclosure region (4).

Figure 3:
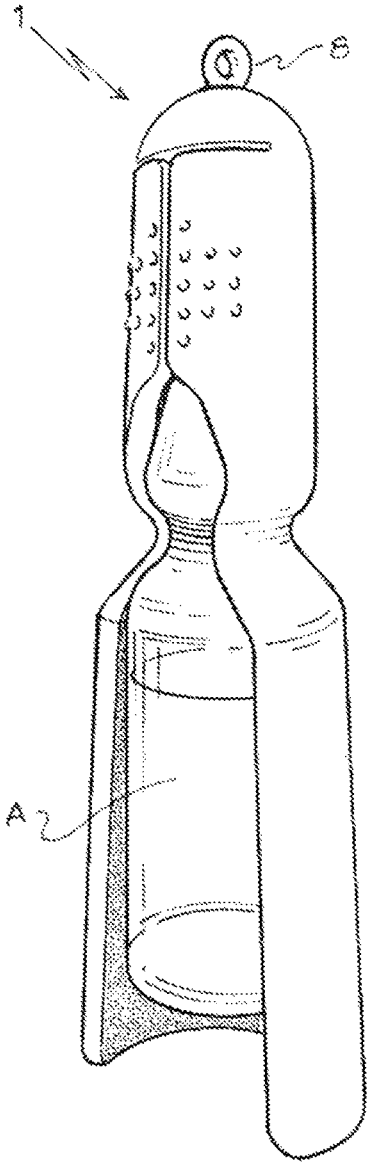
FIG. 3 is a front perspective view of the device containing an ampoule.

FIG. 3 shows an ampoule (A) tightly fitted into the device (1), and arranged for its opening.

Figure 4:
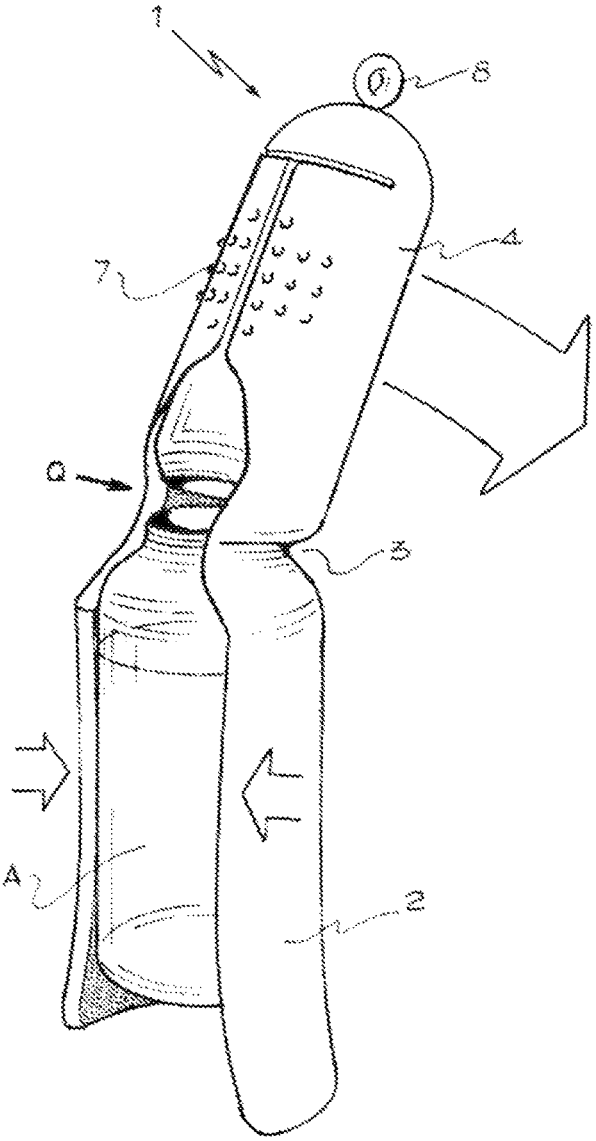
FIG. 4 is a front perspective view of the device during the process of opening the ampoule.

In FIG. 4, with the ampoule (A) installed in the device (1), the lower enclosure region (2) that surrounds the container is held with one hand (not illustrated), and with the other hand (not illustrated) the upper enclosure region (2) has been forced to bend relative to the lower region (4), causing the elastic deformation of the narrowing region (3). The ampoule, being rigid, cannot so deform, and the bending force results in the desired breakage (Q) of the ampoule at the neck. The detached ampoule container may now be withdrawn through the lower opening in the base of the device, while the neck remains trapped in the upper sector (4) for later disposal.

Those skilled in the art will understand that a number of variations may be made in the disclosed embodiments without departing from the scope of the invention, which is defined solely by the appended claims.

We claim:

1. A protective device for hands, for the prevention of cuts in a process of opening ampoules, the device comprising a substantially cylindrical or frustum-shaped hollow body of elastomeric material, the device having an interior conformation similar to an exterior conformation of an ampoule, and the device having:

(a) a lower enclosure section with an opening in its base, the enclosure section and the opening having an inner diameter sufficient to accommodate the ampoule;

(b) an intermediate narrowing region, having a diameter sufficient to accommodate a neck of the ampoule; and (c) an upper enclosure section, having a diameter sufficient to accommodate an closure of the ampoule; and (d) a longitudinal opening in the lower enclosure section, suitable for insertion and removal of the ampoule.

2. The protective device according to claim 1, wherein the longitudinal opening subtends between 90° and 180° of the perimeter of the lower enclosure section.

3. The protective device according to claim 1, wherein the longitudinal opening comprises a larger width in the lower enclosure section, a narrower width in the intermediate narrowing region, and a linear slot in the upper enclosure section.

4. The protective device according to claim 3, wherein the longitudinal opening further comprises a transverse slot intersecting an upper terminus of the linear slot.

5. The protective device according to claim 1, further comprising an eyebolt for the passage of a hanging cord.

6. The protective device according to claim 1, further comprising a plurality of protuberances, grouped so as to define non-slip areas.

* * * * *